US011071387B2

(12) United States Patent
Desanta

(10) Patent No.: US 11,071,387 B2
(45) Date of Patent: Jul. 27, 2021

(54) CHAIR

(71) Applicant: Simon Desanta, Borgholzhausen (DE)

(72) Inventor: Simon Desanta, Borgholzhausen (DE)

( * ) Notice: Subject to any disclaimer, the term of this patent is extended or adjusted under 35 U.S.C. 154(b) by 444 days.

(21) Appl. No.: 16/318,266

(22) PCT Filed: Nov. 19, 2015

(86) PCT No.: PCT/EP2015/077053
§ 371 (c)(1),
(2) Date: Jan. 16, 2019

(87) PCT Pub. No.: WO2016/131504
PCT Pub. Date: Aug. 25, 2016

(65) Prior Publication Data

US 2019/0159596 A1 May 30, 2019

(30) Foreign Application Priority Data

Feb. 19, 2015 (WO) ..... PCT/EP2015/053459

(51) Int. Cl.

| | |
|---|---|
| ***A47C 1/032*** | (2006.01) |
| ***A47C 1/02*** | (2006.01) |
| ***A47C 1/023*** | (2006.01) |
| ***A47C 3/04*** | (2006.01) |

(52) U.S. Cl.
CPC ..... *A47C 1/03261* (2013.01); *A47C 3/045* (2013.01); *A47C 3/04* (2013.01)

(58) Field of Classification Search
CPC ..... A47C 3/04; A47C 1/03255; A47C 7/445; A47C 7/14; A47C 7/40; A47C 7/44; A47C 1/03294
See application file for complete search history.

(56) References Cited

U.S. PATENT DOCUMENTS 2,083,838 A * 6/1937 Goenen ..... A47C 7/445 297/298
4,765,679 A 8/1988 Lanuzzi et al.
4,789,203 A * 12/1988 van Zee ..... A47C 1/03288 297/300.1

(Continued)

FOREIGN PATENT DOCUMENTS

DE 8713972 U1 11/1987
DE 19607136 A1 8/1996

(Continued)

*Primary Examiner* — Shin H Kim
(74) *Attorney, Agent, or Firm* — Richard M. Goldberg

(57) ABSTRACT

Chair (10, 100) with a seat section (14, 104), an underframe (12, 102) which supports seat section (14), and a seat back (16, 106), in which the seat back (16, 106) is mounted on underframe (12, 102) such that it may be pivoted around a rear transverse axis (26, 120) oriented crosswise to chair (10, 100), and seat section (14, 104) is at least partially deformable and is supported or reinforced by at least one stiff supporting element (28, 122) extending from the bottom end of seat back (16, 106) in the direction of seat section (14, 104) and being rigidly connected with seat back (16, 106), such that when a pivoting movement of seat back (16, 106) occurs, a portion of seat section (14, 104) positioned in front of the end of supporting element (28, 122) is raised or lowered depending on the direction of pivoting.

13 Claims, 14 Drawing Sheets

(56) References Cited

U.S. PATENT DOCUMENTS 6,742,838 B1 * 6/2004 Swierczewski ..... B60N 2/4214 297/216.1
6,945,602 B2 * 9/2005 Fookes ..... A47C 1/03255 297/300.2
8,215,710 B2 * 7/2012 Erker ..... A47C 1/03255 297/300.2
8,272,692 B1 * 9/2012 Epperson ..... A47C 1/03272 297/296
9,504,325 B2 * 11/2016 Sander ..... A47C 1/03255
10,058,180 B2 * 8/2018 Desanta ..... A47C 7/448
10,470,574 B2 * 11/2019 Schneider ..... A47C 1/033
2002/0149246 A1 * 10/2002 Lucci ..... A47C 3/04 297/300.1
2003/0151287 A1 * 8/2003 Ueda ..... A47C 3/02 297/301.1
2007/0273190 A1 * 11/2007 Gehner ..... A47C 1/023 297/300.2
2012/0062006 A1 * 3/2012 Hall ..... A47C 1/03272 297/300.5
2014/0110983 A1 * 4/2014 Sander ..... A47C 1/03255 297/284.1
2014/0117732 A1 * 5/2014 Bachar ..... A47C 7/46 297/285
2014/0252824 A1 * 9/2014 Saint Pierre ..... A47C 3/04 297/239
2015/0265052 A1 * 9/2015 Gehner ..... A47C 5/00 297/316
2016/0157615 A1 * 6/2016 Piretti ..... A47C 7/44 297/301.1
2016/0249739 A1 * 9/2016 Schneider ..... A47C 1/03277 297/300.2

FOREIGN PATENT DOCUMENTS

DE 29707354 U1 6/1997
EP 1342432 A2 9/2003

* cited by examiner

CHAIR

BACKGROUND OF THE INVENTION

The present invention concerns a chair with a seat section, an underframe which supports the seat section and a seat back.

As is known, chairs come in a wide variety of designs. In the simplest design, the seat back is rigidly attached to the seat section which is in turn supported by an underframe with four legs. Chairs used for seating in halls and event rooms frequently come with side elements for lateral connection with an adjacent chair. Furthermore, such chairs for sitting in rows are usefully designed to be stacked to allow space-saving storage. A connected chair of this type is disclosed in WO 2008/064886 for example.

To enhance comfort and ergonomy, it is desirable that the chair is able to adapt to a certain extent to the weight of the person sitting on it. When solicited, the seat back should give a little yet still provide sufficient support to the user. The seat section may also be of a resiliently pliant design and connected to the seat back in such a way that an equilibrium of forces is achieved and changes dynamically with changes of body position.

Chairs of this type generally have a comparatively simple spring technology, with the spring pressure being adapted to relatively heavy or large persons in particular. Lighter persons are therefore scarcely able to make use of the motion mechanism of the chair with associated comfort. Furthermore, the prior art stackable connected chairs may be moved out of the unsolicited position, which corresponds to the position for stacking, into a relaxation position in which the seat back is tilted slightly backwards. They cannot, however, be moved into a supported forward sitting position in which the seat back is tilted forward out of the unsolicited position and also supports the person sitting on the chair in a forward-oriented sitting position. For lengthy periods of sitting, such mobility is advantageous and improves ergonomy. From a mechanical point of view, appropriate solutions are too complex and costly for connected chairs and have thus far only been used for office chairs and swivel chairs. The constructions used for this purpose are relatively complex and costly, and are therefore difficult to transfer to connected chairs.

SUMMARY OF THE INVENTION

Hence it is a task of the present invention to develop a chair which, despite a comparatively simple, inexpensive design, offers a high degree of ergonomy and comfort and is suitable for use as a connected chair in particular, or other similar purposes. This chair should, in particular, be equally comfortable and easy to use for persons of different body weights and should also provide a supported forward sitting position of the type described above.

This task is solved according to the invention by a chair with the features of the claims.

In the chair according to the invention, the seat back is pivotably mounted on the underframe so that it can yield when solicited by the user's back. From the bottom end of the seat back, a supporting element extends in the direction of the seat section which is at least partially deformable. The seat section may be elastically deformable as a whole, for example, or it may have different portions connected e.g. by a type of hinge so that a pivot mechanism is formed between mutually deformable parts. The supporting element, on the other hand, is stiffly and rigidly connected with the seat back so that it can follow the latter's pivoting motion around the transverse axis mounted at the rear of the underframe. If the seat back is pivoted backwards, the supporting element follows this pivoting motion upwards or indeed downwards if the seat back is pressed forward.

The supporting element supports or reinforces the seat section in such a manner that when the seat back performs a pivoting movement as described above, a portion of the seat section in front of the end of the supporting element is raised or lowered depending on the direction of pivoting. This means that the seat back is connected to the seat section via the supporting element in such a way that the part of the seat section solicited by a person sitting on it can be raised or lowered.

If the user leans backward, the supporting element and the rear portion of the seat back presses the solicited part of the seat section upward. If the user leans forward, the result is a slightly forward seating position with a seat back that is pressed forward. A certain spring effect is therefore achieved automatically. Overall, a dynamic equilibrium is achieved as a function of the load.

The mechanism according to the invention offers the user a relaxed leaned-back position as well as a forward sitting position with seat back pressed forward. The ergonomic benefits of this chair may be used essentially irrespective of the user's weight.

The mechanism of the chair according to the invention is comparatively simple and can therefore be inexpensively installed in chairs for use in large numbers, in particular connected chairs providing seating in halls. Another advantage is that, given the simplicity of the construction according to the invention, it may be installed in underframes used primarily for connected chairs, i.e. chairs which can be laterally connected with adjacent chairs and which are stackable.

According to a preferred embodiment of the present invention, the supporting element reinforces a rear portion of the seat section or is contrived as one piece with this latter. This means that the supporting element stiffens the rear portion of the seat section segment by segment so that it is no longer flexible, but can follow the pivoting movement of the seat back.

Further, the supporting element preferably reinforces each one of the two rear corner portions of the seat section and a central rear portion of the seat section positioned between these corner portions is separated from the corner portions by slots which extend from the seat back into the seat section. In this case, only the corner portions are stiffened whilst the area inbetween offers a certain mobility and compliance due to its flexibility.

According to another preferred embodiment, the front end of the seat section is rigidly connected with the underframe.

In an alternative embodiment, the front end of the seat section rests freely on the front end of the underframe.

The seat section is preferably elastically deformable. It will therefore always endeavour to return to its original form when released from a force acting on it, i.e. a burden of weight or a force acting on the seat section via the supporting element. The elasticity therefore acts as a restoring moment.

Further preferably, the supporting element is contrived as a lever which extends underneath the seat section from the rear and is connected to the seat section via a joint whose axis is positioned parallel to the rear transverse axis of the seat back.

Further preferably, a front part of the seat section extending forwards from the joint is connected to the underframe by a pivot bearing disposed in front of the joint, by means of which the front part of the seat section is mounted on the underframe such that it can be pivoted upwards and downwards.

Further preferably, the chair comprises a restoring element for restoring the lever and seat section from a deflected position to a resting position. This may be, for example, a suitable spring mechanism which retains the chair in the resting position in the unsolicited state.

According to another preferred embodiment, the pivot bearing comprises a pivot axis disposed rigidly on the underframe, which is positioned inside a bearing sleeve with play, the latter being rigidly connected to the underside of the front end of the front part of the seat section or is contrived as one piece with this latter so that the sleeve can be moved forwards and backwards along the pivot axis. That means that the front part of the seat section is positioned inside the pivot bearing with a certain amount of play. This play may be required to permit the above-described upward and downward pivoting motion.

According to another preferred embodiment, the restoring element comprises springs positioned opposite each other in the bearing sleeve between the sleeve wall and the pivot axis and retain this latter in a resting position in the unsolicited state, representing an intermediate position between a maximum forward position and a maximum backward position inside the sleeve. The springs therefore press the pivot axis back into a resting position which may represent a medium position within the sleeve.

A rear part of the seat section is preferably connected to a front part of the same by means of a film hinge. This allows the front and rear parts of the seat section to perform a certain pivoting motion in relation to each other.

Further preferably, the chair according to the invention is contrived to be stacked on top of an identical chair.

BRIEF DESCRIPTION OF THE DRAWINGS

Further features and advantages of the present invention are disclosed in the following description of a preferred embodiment example with reference to the following drawings, in which.

DETAILED DESCRIPTION

Figure 1:
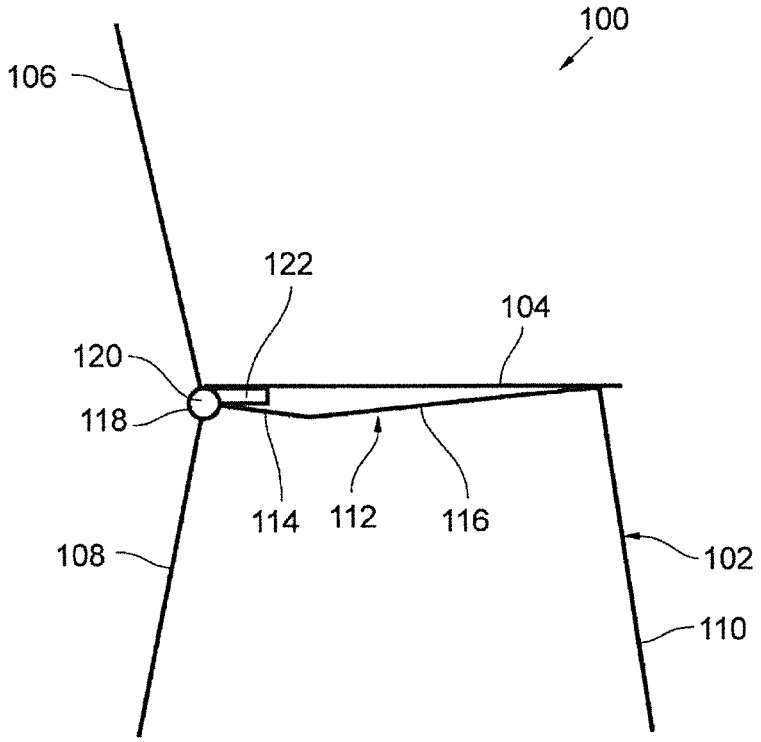
FIG. 1 is a schematic representation of a chair according to an embodiment of the present invention in a side view in which the chair is shown in a resting position.

The chair 100 shown in FIG. 1 comprises an underframe 102, a seat section 104 and a seat back 106. In the usual manner, seat section 104 is essentially horizontal whereas seat back 106 is tilted slightly backwards. Note that the terms "forward", "backward", "at the side" relate to the perspective of the person sitting on chair 100. This means that seat back 106 is disposed at the rear on the back side of chair 100 and all other positions and spatial orientations relate to this.

Seat back 106 is inclined slightly backward with respect to the vertical position and forms an angle of slightly more than 90 degrees with seat section 104. The position shown in FIG. 1 represents a resting position of chair 100 in the unsolicited state, from which various parts of chair 100 may be moved into the positions shown in FIGS. 2 and 3, as will be explained in more detail below.

The underframe 102 comprises four chair legs in the usual manner, of which only the right rear leg 108 and the right front leg 110 can be seen in FIG. 1. Legs 108, 110 are connected on each side of chair 100, i.e. the right and left sides, by an essentially horizontal strut 112. In the present embodiment example, strut 112 is bent slightly so that it comprises a rear part 114, which is inclined slightly upwards towards seat back 106, and a front part 116, which is inclined slightly upward towards the front end of chair 100. As a whole, together with the essentially horizontal strut 112, legs 108, 110 form a configuration which essentially takes the shape of an inverted letter "U".

A bearing 118 for a horizontal transverse axis 120 is disposed in the top rear corner of this configuration at which the top end of the right rear leg 108 connects with the rear end of strut 112. This transverse axis 120 is positioned crosswise with respect to chair 100 and is fixed in a similar bearing on the left chair side not shown in FIG. 1. Seat back 106 may be pivoted around this transverse axis 120 to permit changes of inclination.

From the bottom end of seat back 106 a pair of supporting elements 122 project in the direction of seat section 104. Specifically, from each rear corner of chair 100 a supporting element 122 extends forwards and reinforces the respective rear corner portion of the seat section, and stiffens it. For example, the entire length of supporting element 122 may abut against seat section 104 from below, and be attached to it. It is also conceivable that supporting element 122 is contrived or formed as one piece with seat section 104 in this corner portion.

Whereas seat section 104 may be made from an elastically deformable material, the respective supporting elements 122 are rigid. Hence seat section 104 is not elastic in the reinforced or supported rear corner portions. A central portion of seat section 104 positioned between the corner portions may exhibit a certain elasticity, however, and for this purpose be separate from the reinforced and stiffened corner portions by slots, for example, which extend from seat back 106 into seat section 104.

Supporting element 122 is rigidly connected with seat back 106 and follows its pivoting movement around transverse axis 120, as shown below. As a result, a portion of seat section 104 positioned ahead of the front end of supporting element 122 is raised or lowered depending on the pivot direction of seat back 106.

Figure 2:
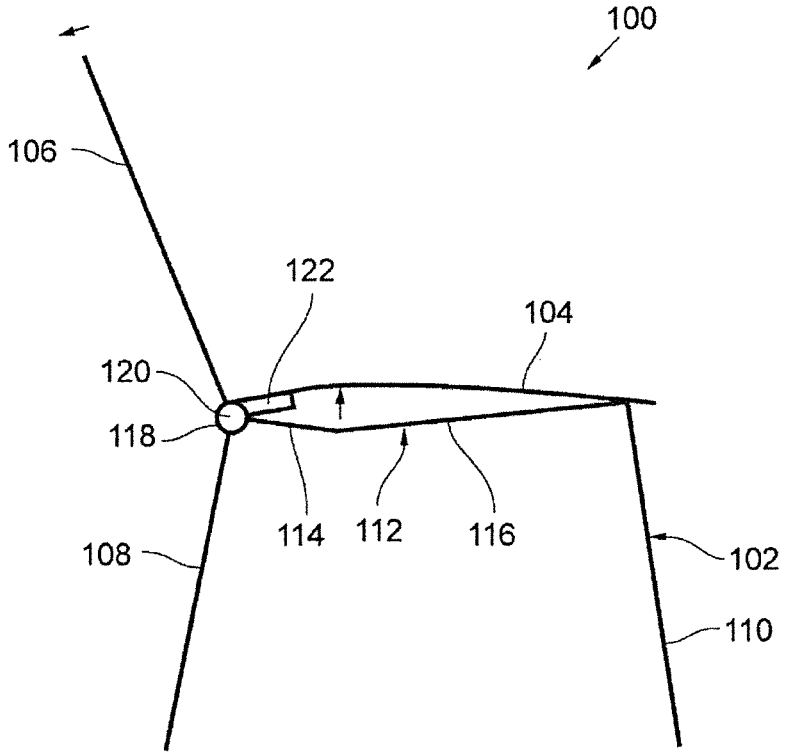
FIGS. 2 and 3 are illustrations of the chair of FIG. 1 in different deflected positions of the seat back and seat section.

FIG. 2 shows, for example, how seat back 106 is tilted backward. This situation may occur when a person sitting on the seat leans back, for example, thereby exerting rearward pressure on seat back 106. Supporting element 122 which follows this tilting movement (anticlockwise in FIG. 2) exerts pressure from below on seat section 104 which causes an approximately central portion of seat section 104 positioned at a distance from seat back 106, to be raised slightly. As the front end of seat section 104 is rigidly connected with underframe 102 in the present embodiment, the flexible seat section 104 is deformed, i.e. deflected upwards against the weight of the user sitting on seat 100. Due to this weight burden, seat section 104 strives to return to its original shape in FIG. 1 (i.e. downward) and given the rigid connection between supporting element 122 and seat back 106, seat back 106 is pushed forward against the user's back.

Depending on the user's weight, therefore, and his or her body position, which may cause a shift in weight, a new equilibrium position of seat back 106 and seat section 104 is reached.

Note that, contrary to the embodiment shown here, the front end of seat section 104 need not necessarily be rigidly attached to underframe 102. Rather, the front end of seat section 104 may also rest freely on underframe 102, held in place on the front upper edge of underframe 102 solely by the user's weight force which is exerted in particular by the upper thigh resting on the front end of seat section 104.

Figure 3:
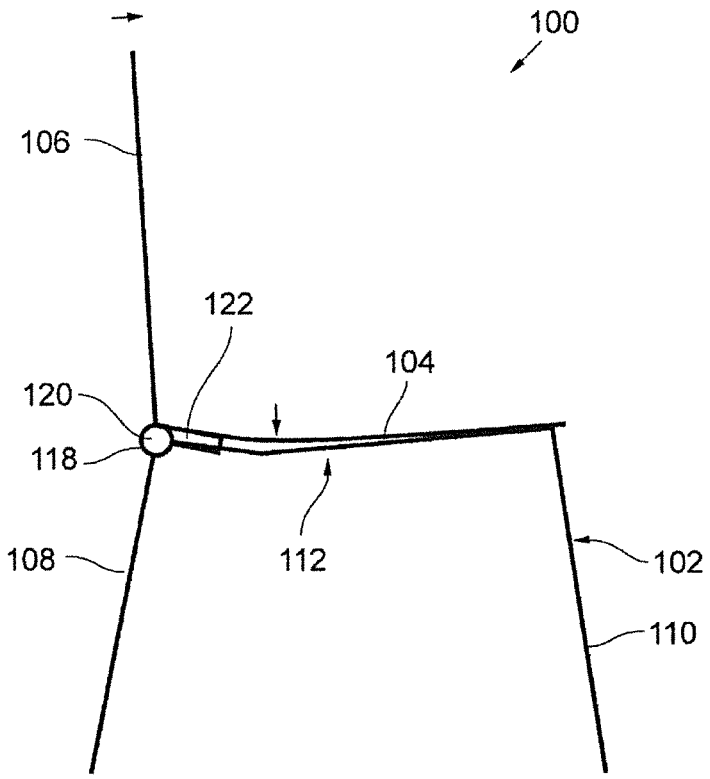

If, starting from the position in FIG. 2, seat back 106 is tilted in the opposite direction (i.e. clockwise), and specifically beyond the resting position shown in FIG. 1, the position shown in FIG. 3 is achieved in which seat section 104 is deflected slightly downward out of its resting position, i.e. in the opposite direction compared to FIG. 2. This position may be reached if the user of chair 100 leans forward slightly. In this case, due to its elasticity, seat section 104 yields slightly downward. Seat section 104 may be fixed to underframe 102 in such a way that when moving into the position in FIG. 3, a stop is reached at which the left and right side edges of seat section 104 rest on the horizontal strut 112 of underframe 102 so that further deflection in the downward direction is not possible.

From the position in FIG. 3, seat section 104 and seat back 106 can move back to the position in FIG. 1, when the user stands up, for example, thereby releasing seat section 104 from the weight force acting on it. Seat section 104 then attempts to return to its horizontal position due to its elasticity, and the resultant restoring force is transferred via supporting element 122 to seat back 106 which is rigidly connected to it.

The effect according to the invention of creating a dynamic equilibrium position of the seated person is achieved essentially as a result of the supporting element 122, which is rigidly connected with seat back 106, pushing seat section 104 upwards during a tilting movement of seat back 106, or permits a downward movement of the same, whereby this portion, or a portion of seat section 104 located in front of the end of supporting element 122, is raised or lowered. Seat section 104 may be elastically deformable for this purpose, through choice of a suitable bendable material, or may be separated into front and rear portions by means of a hinge such as a film hinge, said portions being slightly pivotable relative to each other. Hence various embodiments are conceivable for ensuring the deformability of seat section 104. It is also conceivable that supporting element 122 be formed by a rear reinforced portion of seat section 104, i.e. it is not a separate element, but rather seat section 104 itself is rigid and non-bendable across a rear portion facing seat back 106, whilst a section 104 located in front of it is elastic or separated from this rear rigid section by a film hinge or such like.

Chair 100 according of the first embodiment can be designed as a stackable chair or further developed into such a chair. In this respect, the details shown in FIGS. 1 to 3 should not be considered limiting for the present Invention to the effect that they stand in the way of such stackability. Furthermore, the mechanism according to the invention Is not associated solely with stackable chairs, but may also be used with other underframe constructions, e.g. for office chairs with a swivel frame.

The following FIGS. 4 to 15 show a second embodiment of chair 10 according to the invention. Like the chair 100 shown in FIGS. 1 to 3, chair 10 according to the second embodiment comprises an underframe 12, a seat section 14 and a seat back 16. As usual, seat section 14 is essentially horizontal and disposed on underframe 12 such that it slopes only slightly towards the rear, i.e. towards seat back 16.

Seat back 16 is inclined slightly backwards with respect to the vertical position and forms an angle of slightly more than 90 degrees with seat section 14. The position shown in FIG. 4 represents a resting position of chair 10 in the unsolicited state, from which various parts of chair 10 may be moved into other positions as will be explained in more detail below.

Figure 4:
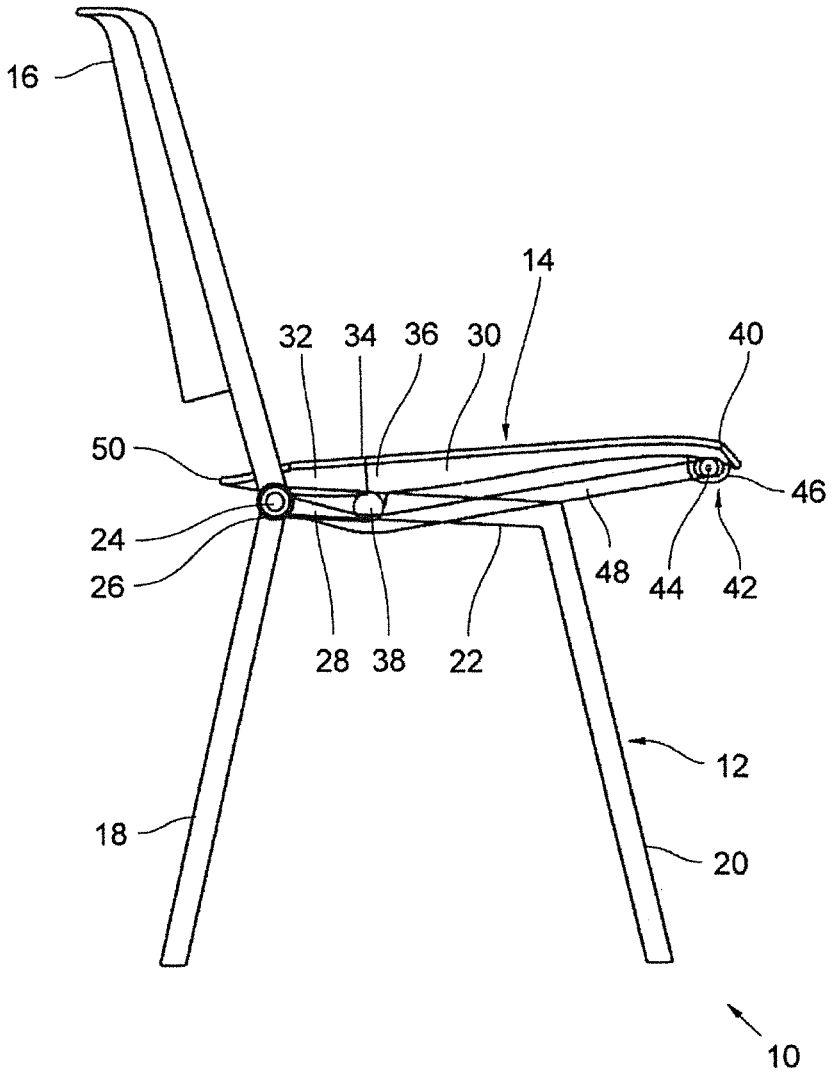
FIGS. 4 to 6 are side views of a second embodiment of the chair of the invention in three different positions of the seat back and seat section.

Underframe 12 comprises, in the usual manner, four legs, of which only the right rear leg 18 and the right front leg 20 are shown in FIG. 4. Legs 18,20 are each connected on one side of chair 10, i.e. on its right and left sides by an essentially horizontal and slightly downward oriented strut 22. Together with the right strut 22, the right legs 18,20 form a configuration which essentially takes the form of an inverted letter "U".

A bearing 24 for a horizontal transverse axis 26 is disposed on the top rear corner of this configuration where the top end of the right rear leg 18 connects with the rear end of right strut 22. This transverse axis 26 is positioned crosswise with respect to chair 10 and is fixed in a similar bearing on the left chair side not shown in FIG. 4. Seat back 16 may be pivoted around this transverse axis 26 to permit changes of inclination.

From the bottom end of seat back 16 a pair of levers extends underneath seat section 14 from the rear. In the present second embodiment of chair 10, these levers form the supporting element for supporting seat section 14. In the side views in FIGS. 4 to 6 only one lever 28 is visible, which will be referred to in the following description. Lever 28 (and its counterpart on the opposite side of chair 10) may for example be rigidly attached to transverse axis 26, which rotates together with seat back 16 inside bearing 24. Lever 28 therefore follows the pivot movement of seat back 16. If seat back 16 is tilted backward, the front end of lever 28 rises and exerts pressure on seat section 14 from below.

Seat section 14 is essentially divided into two parts in the crosswise direction, namely a longer front part 30 and a shorter rear part 32. Front part 30 is connected with rear part 32 by a film hinge 34 whose hinge axis lies approximately in the top side, i.e. in the actual seat surface of seat section 14. Hence both parts 30, 32 of seat section 14 are flexibly connected with each other so that the rear part 32 can perform a slight pivot movement relative to the front part 30. Hence seat section 14 is deformable.

The rear end 36 of the front part 30 of seat section 14 is connected to the end of lever 28 on the underside of seat section 14 by means of a joint 38. The joint axis of this joint 38 is positioned horizontal and parallel to the rear transverse axis 26. The front end 40 of the front part 30 of seat section 14 is connected with underframe 12 via a pivot bearing 42 which allows the front part 30 of seat section 14 to be pivoted upwards and downwards in relation to underframe 12 so that the rear end of this front part 30 can be raised or lowered. Specifically, this pivot bearing 42 comprises a pivot axis 44 which is positioned with play in the forwards and backwards direction inside a bearing sleeve 46, which is rigidly moulded on the underside of the front end 40 of front part 30 of seat section 14. This play allows, in addition to the pivotability of front part 30 of seat section 14 in the upwards and downwards direction, a slight displacement of the front part 30 in the forwards and backwards direction.

Pivot axis 44 is positioned horizontally in the transverse direction of the chair, i.e. parallel to the rear transverse axis 26, and is held in place by a pair of centre struts 48 which are a fixed part of underframe 12 and project forwards from rear transverse axis 26 centrally and underneath seat section 14. They rest on a front transverse strut 60 not shown in FIG. 4 (see FIG. 14) of underframe 12 which runs between the top ends of front legs 20 and, in the vicinity of joint 38, exhibit a slight bend from which the longer front ends of centre struts 48 and the shorter rear ends are inclined upwardly. At their rear ends, centre struts 48 are pivotably connected with rear axis 26.

The rear part 32 of seat section 14 rests with its rear end 50 on the rear transverse axis 26 and is therefore supported by this latter.

As a whole, seat section 14 is therefore divided into essentially two parts, namely the front part 30 and the rear part 32, which are flexibly connected by film hinge 34 so that they are able to move relative to each other. This mobile seat section 14 is supported from underneath by lever 28 which projects rigidly from seat back 16 so that a movement of seat back 16 is transferred to seat section 14 via the rear transverse axis 26, lever 28 and joint 38. This mechanism will be described in more detail below.

Figure 5:
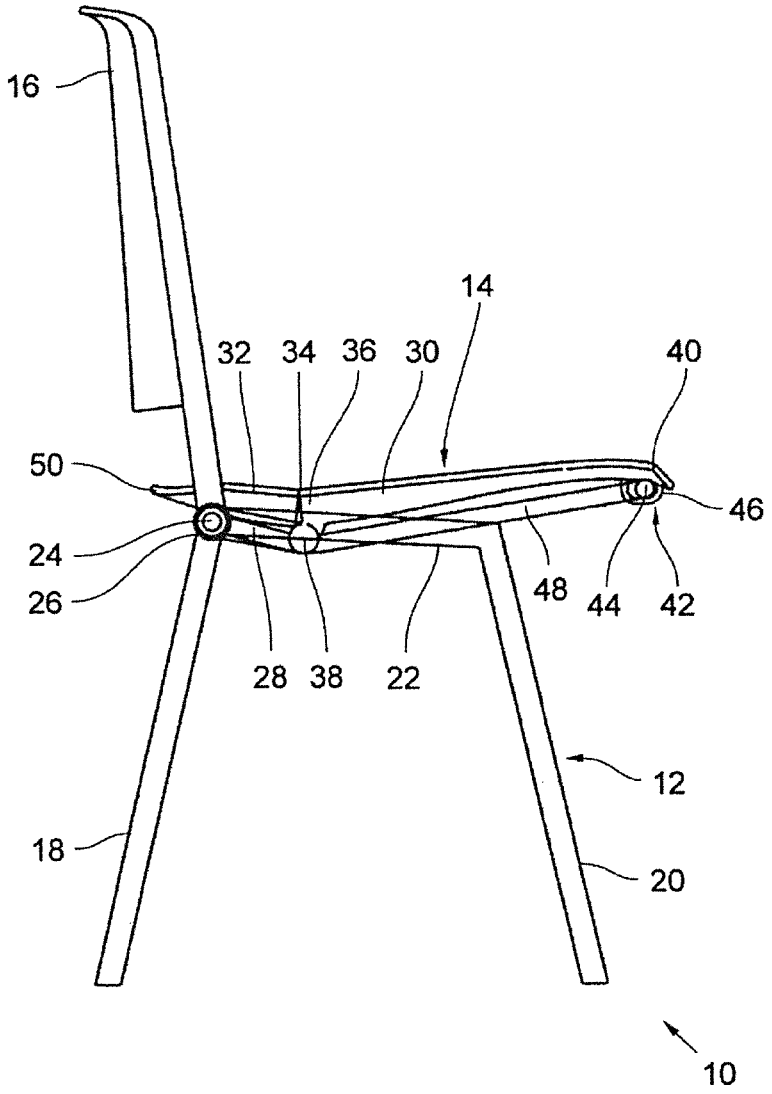

Starting from the unsollicited position shown in FIG. 4, if seat section 14 of chair 10 is sollicited from above, e.g. by the weight of someone sitting down on chair 10, seat section 14 starts by yielding downwardly, as shown in FIG. 5. As this takes place, the rear end 36 of the front part 30 of seat section 14 is pivoted downward around pivot axis 44 of pivot bearing 42 so that the rear end 36 is lowered and exerts a pressure from above on the end of lever 28. This latter is also pressed downward. Due to the rigid connection between lever 28 and seat back 16, seat back 16 is pressed forward against the user's back. When leaning backward, the user exerts a counterpressure on seat back 16 and a new equilibrium position of seat back 16 and seat section 14 is reached depending on the user's weight and body position, which causes a shift of weight. If the user shifts his weight backward, he presses seat back 16 backward, causing lever 28 to exert pressure against seat section 14 from underneath. This in turn raises the rear end 36 of the rear part 30 of seat section 14 again.

Figure 6:
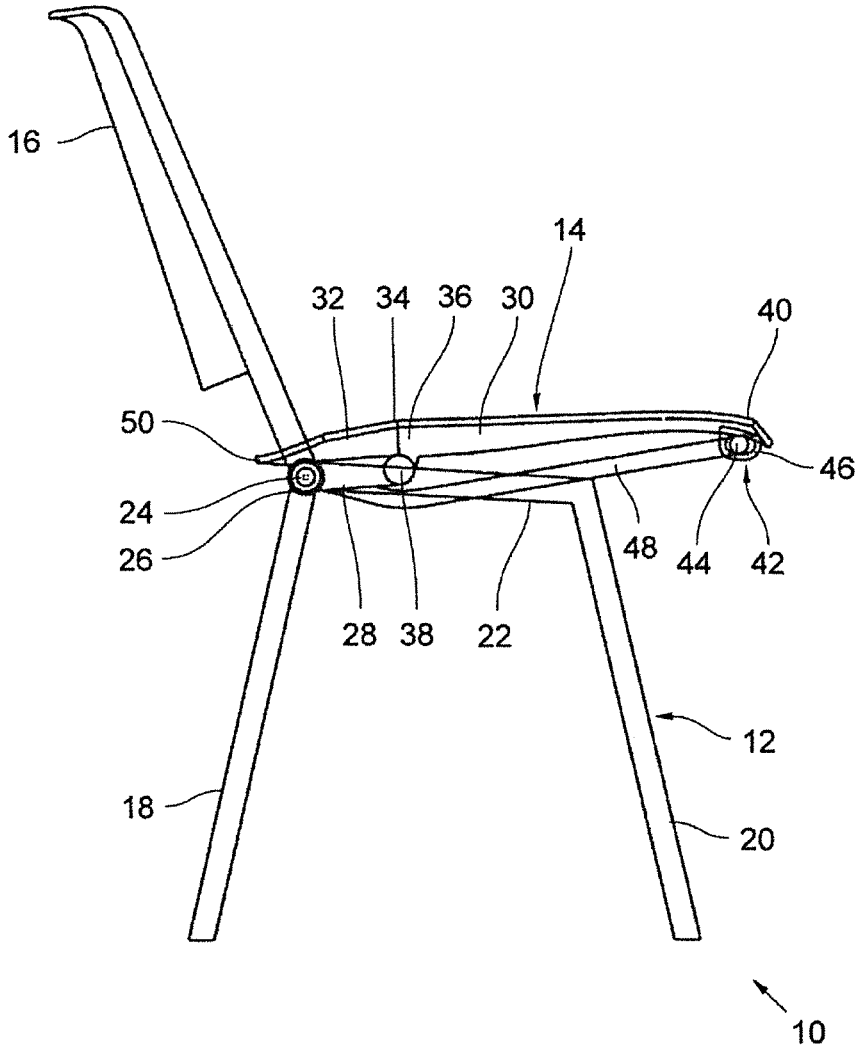

This raised position above the resting position shown in FIG. 4 is illustrated in FIG. 6. Here, the position of the front part 30 of seat section 14 is approximately horizontal, whilst the rear part 32 of seat section 14, starting from the axis of film hinge 34, slopes downward and rearward. Whereas the front part 30 and the rear part 32 of seat section 14 are almost flush with each other in the resting position shown in FIG. 4, i.e. lie approximately in the same plane, the two parts 30, 32 illustrated in the extreme positions shown in FIGS. 5 and 6 are angled relative to each other. The rear end 50 of the rear part 32 always rests on the rear transverse axis 26 in the different positions and is supported by this latter.

As the rear transverse axis 26 and the front pivot axis 44 of pivot bearing 42 occupy a fixed position relative to underframe 12 and have a fixed distance relative to each other, the front part 30 of seat section 14 must be mounted on underframe 12 with a certain amount of play in the forwards and backwards direction in order to compensate for the varying distance between joint 38 and pivot axis 44 during the pivoting movement. This degree of play is achieved by bearing sleeve 46 being wider in the forwards and backwards direction than the diameter of pivot axis 44, so that bearing sleeve 46 can be displaced forwards and backwards along pivot axis 44. This is shown in FIGS. 5 and 6. In FIG. 5, in which the rear end 36 of the front part 30 of seat section 14 is lowered, this front part 30 is pulled slightly backward so that pivot axis 44 abuts against a front wall of sleeve 46. The opposite case occurs in FIG. 6, where the front part 30 of seat section 14 is pushed slightly forward during the rising movement of its rear end 36 so that pivot axis 44 approaches a rear wall of bearing sleeve 46.

Figure 7:
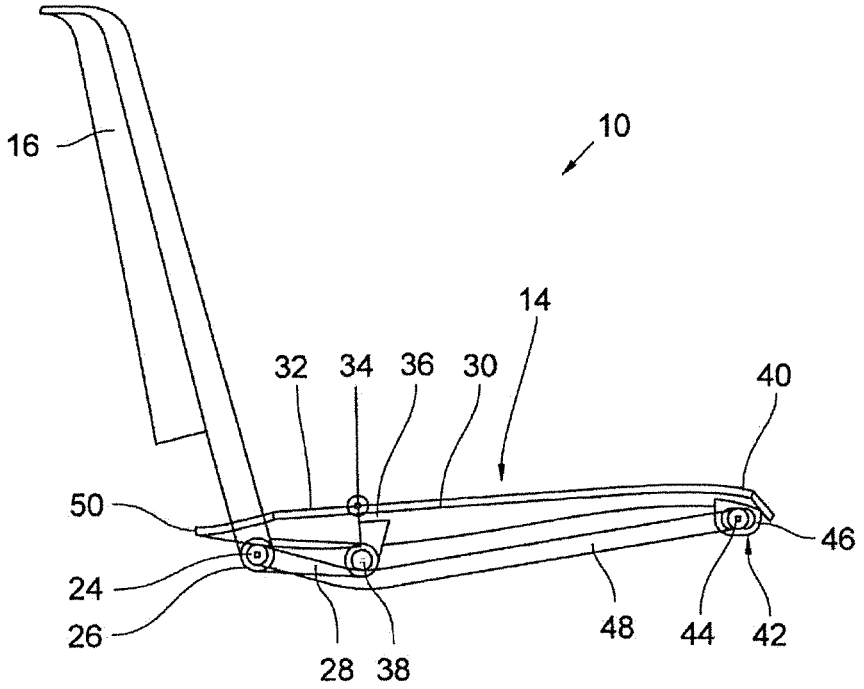
FIGS. 7 to 9 are detailed views of the chair of FIGS. 4 to 6, also in different positions.
Figure 8:
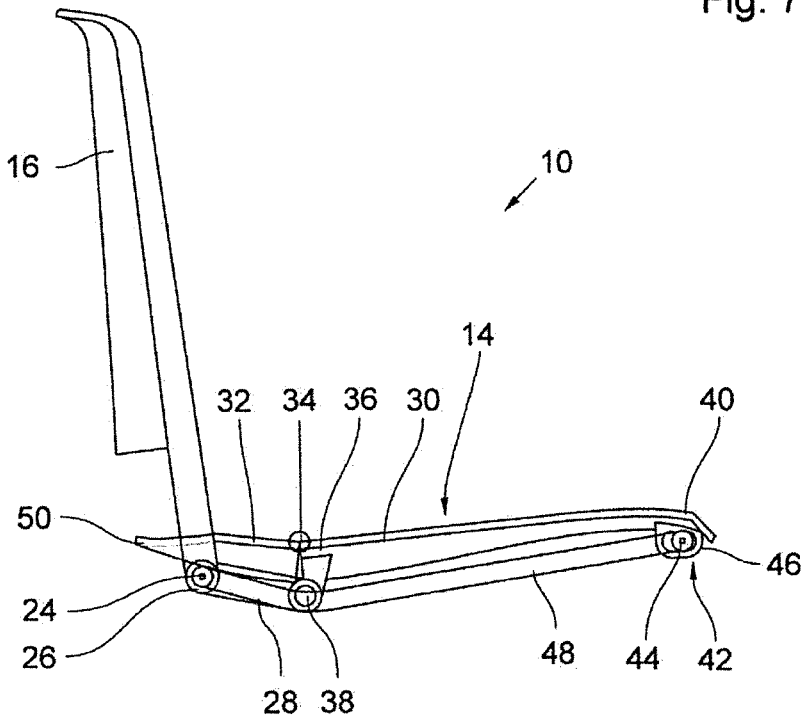
Figure 9:
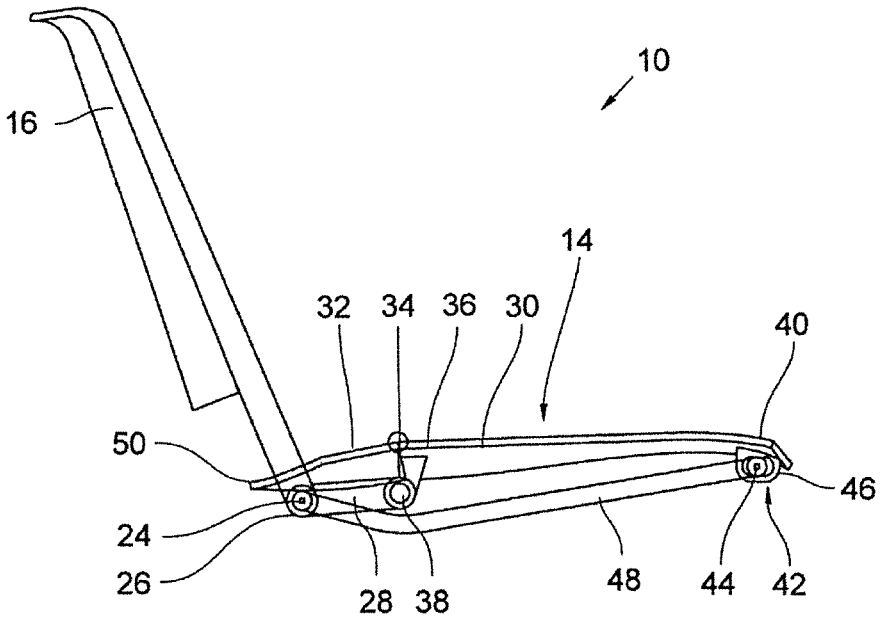

The linking of the movement of the individual parts with each other is shown again more clearly in the detailed views in FIGS. 7, 8 and 9, in which FIG. 7 illustrates the resting position of chair 10 as per FIG. 4, and FIGS. 8 and 9 correspond to the positions shown in FIGS. 5 and 6.

Figure 10:
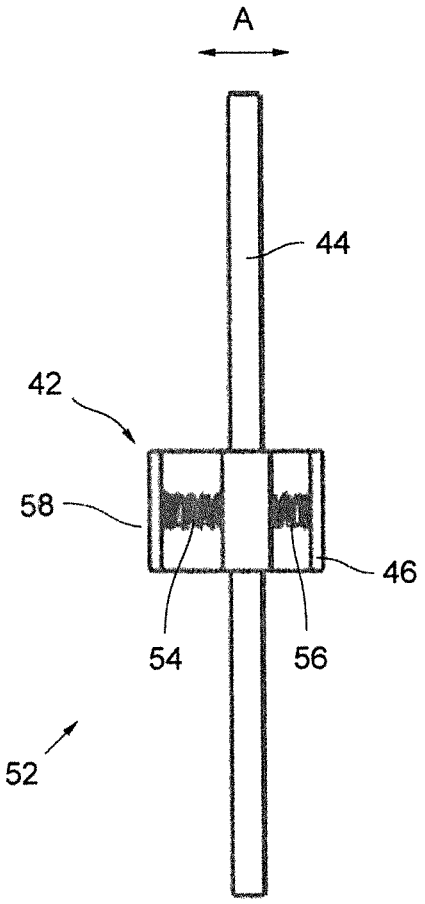
FIG. 10 is a schematic detailed view of the restoring element of the second embodiment of the chair according to the invention.
Figure 11:
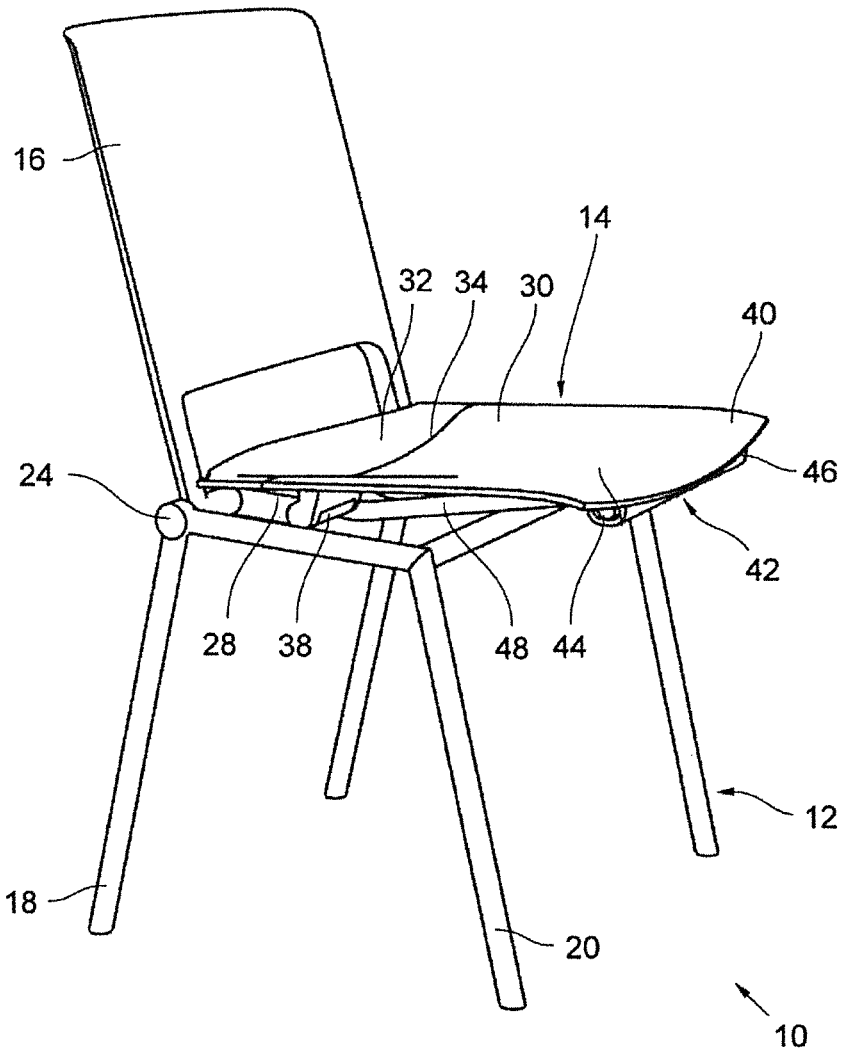
FIGS. 11 & 12 are perspective views of the second embodiment of the chair according to the invention in different positions.

For the purpose of restoring lever 28 and seat section 14 from a deflected position as shown in FIGS. 5 and 6 to the resting position of FIG. 4, chair 10 comprises a restoring element 52 inside pivot bearing 42 with two springs 54, 56 positioned opposite each other inside bearing sleeve 46 between sleeve wall 58 and pivot axis 44, as shown schematically in FIG. 10. The two springs 54, 56 positioned opposite each other against pivot axis 44, press pivot axis 44 into the resting position shown in FIG. 10. Whilst the front part 30 of seat section 14 performs the pivot movement shown in FIGS. 4 to 6 and 7 to 9, this part 30 is simultaneously moved backward and forward in relation to pivot axis 44. If, for example, pivot axis 44 in the solicited position of chair 10 shown in FIG. 5 is pushed forward inside pivot bearing 42, i.e. bearing sleeve 46 is moved backward relative to the fixed pivot axis 44 so that spring 56 in FIG. 10 is compressed. If chair 10 is released from the solicited position in FIG. 5, spring 56 presses the front side of sleeve wall 58 of bearing sleeve 46 forward so that pivot axis 44 is moved backward in relation to the latter and returns to the resting position shown in FIG. 10 or FIG. 4 or FIG. 7.

Figure 12:
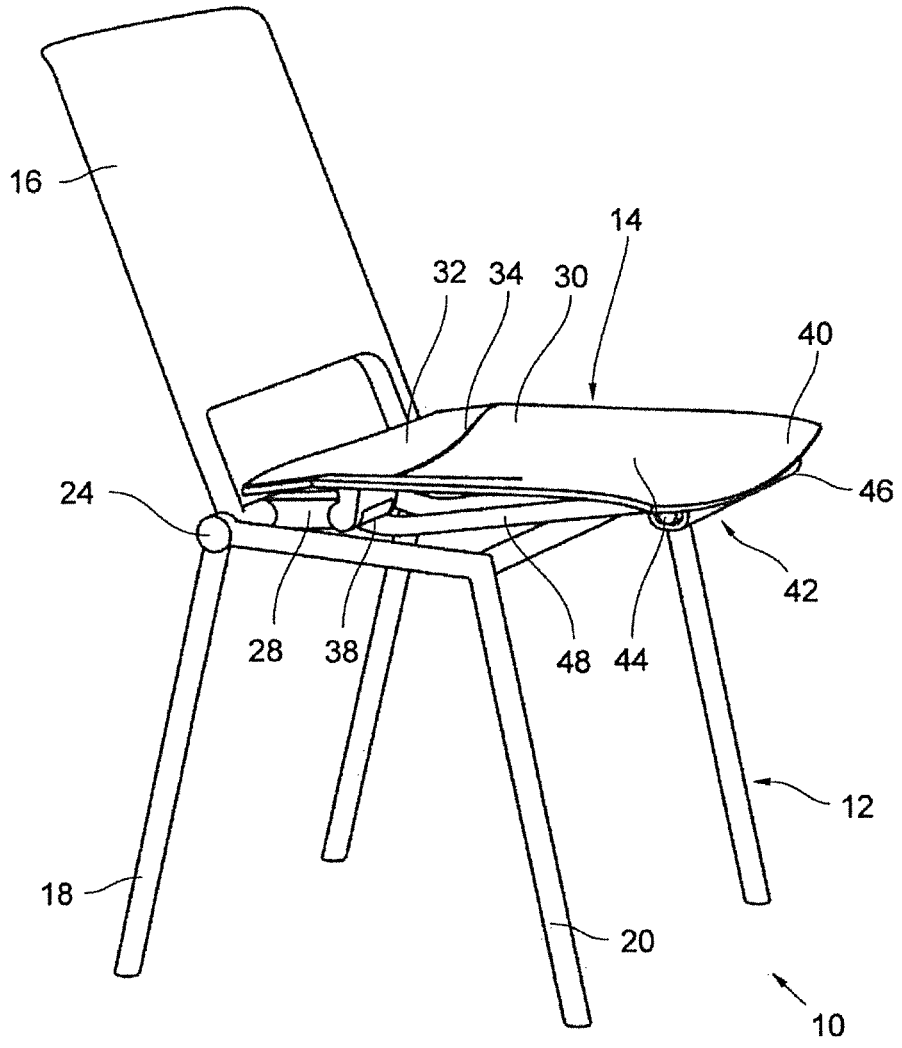

Conversely, in the position shown in FIG. 9 and FIG. 12, bearing sleeve 46 is pushed forward relative to pivot axis 44 so that the opposite spring 54 is compressed and, when the load is released, presses bearing sleeve 56 back into the resting position relative to pivot axis 44.

The positions shown in FIGS. 5 and 6, and in FIGS. 8 and 9, represent maximum forward and backward positions of pivot axis 44 relative to bearing sleeve 46, between which the position shown in FIGS. 4, 7 and 10 represents an intermediate position.

Figure 13:
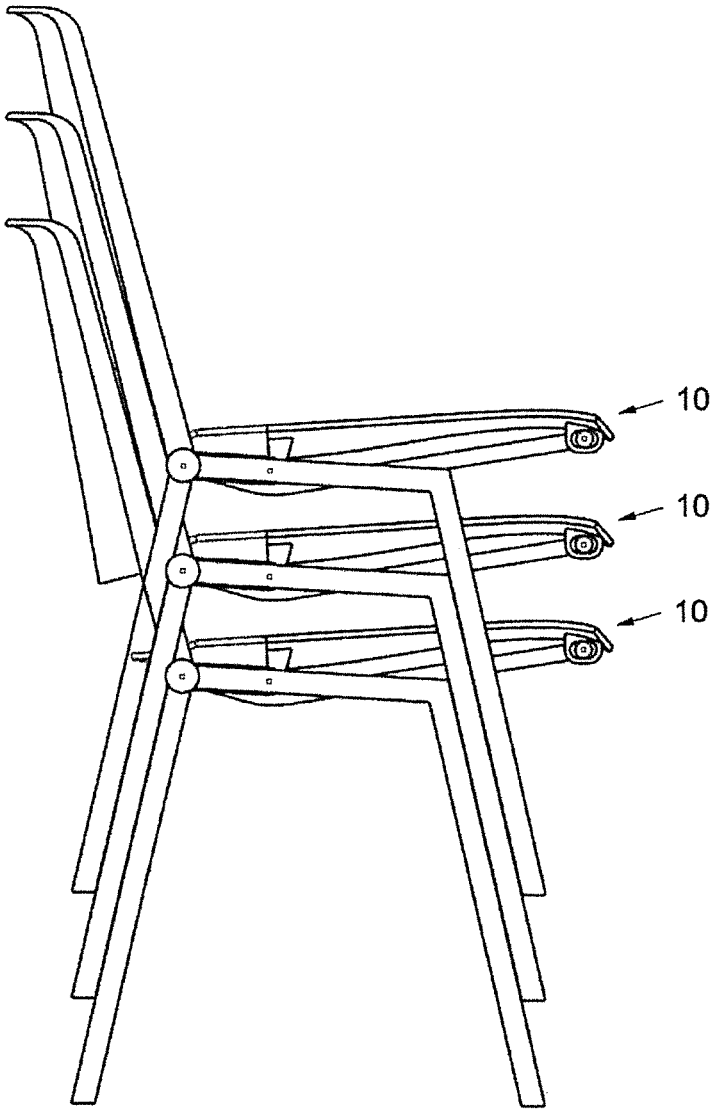
FIG. 13 shows three identical examples of the second embodiment of the chair according to the invention when stacked.

The present embodiment of chair 10 permits stacking of several identical chairs 10 on top of each other, as shown in FIG. 13. This is made possible by the very simple mechanism of chair 10, allowing the construction of underframe 12 to be kept simple. It is further possible to provide connecting means on horizontal side struts 22 for connecting a chair 10 with an adjacent chair 10 at left or right. Such stacking is also possible with chair 100 of the first embodiment.

Figure 14:
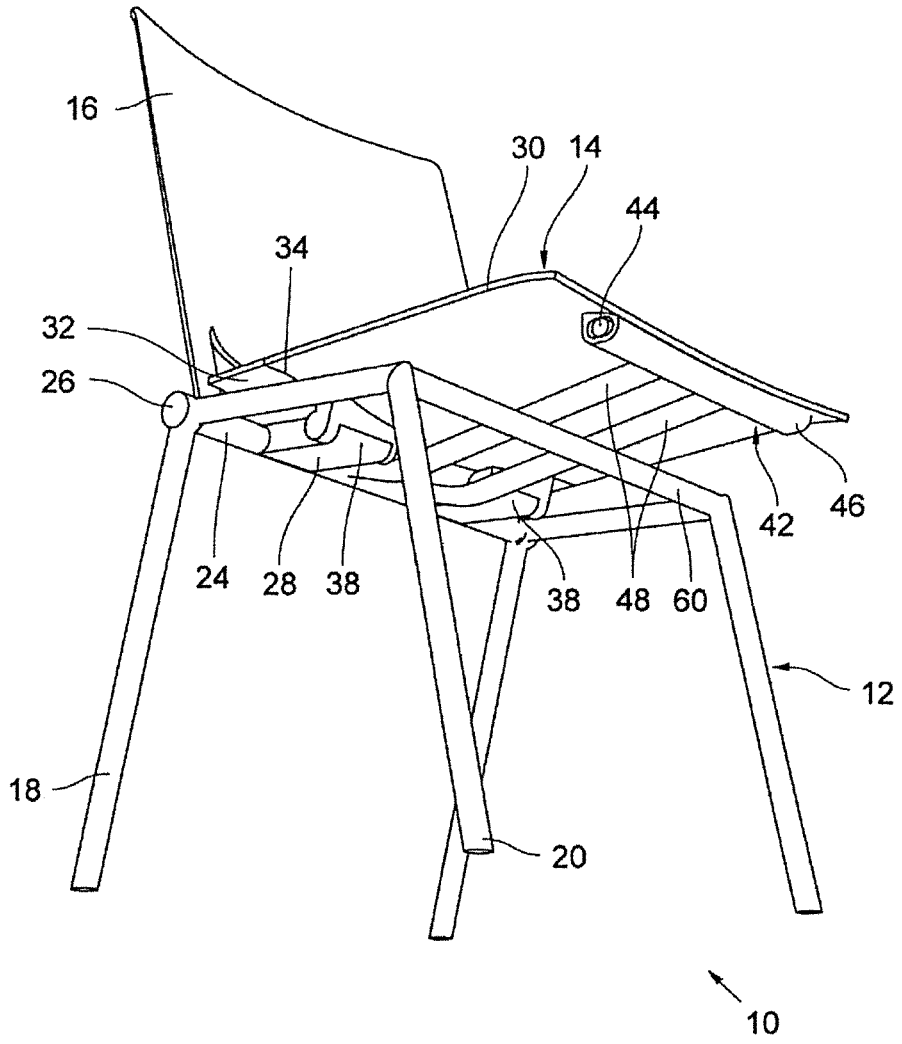
FIG. 14 is a perspective view of the second embodiment of the chair according to the invention seen at an angle from below.
Figure 15:
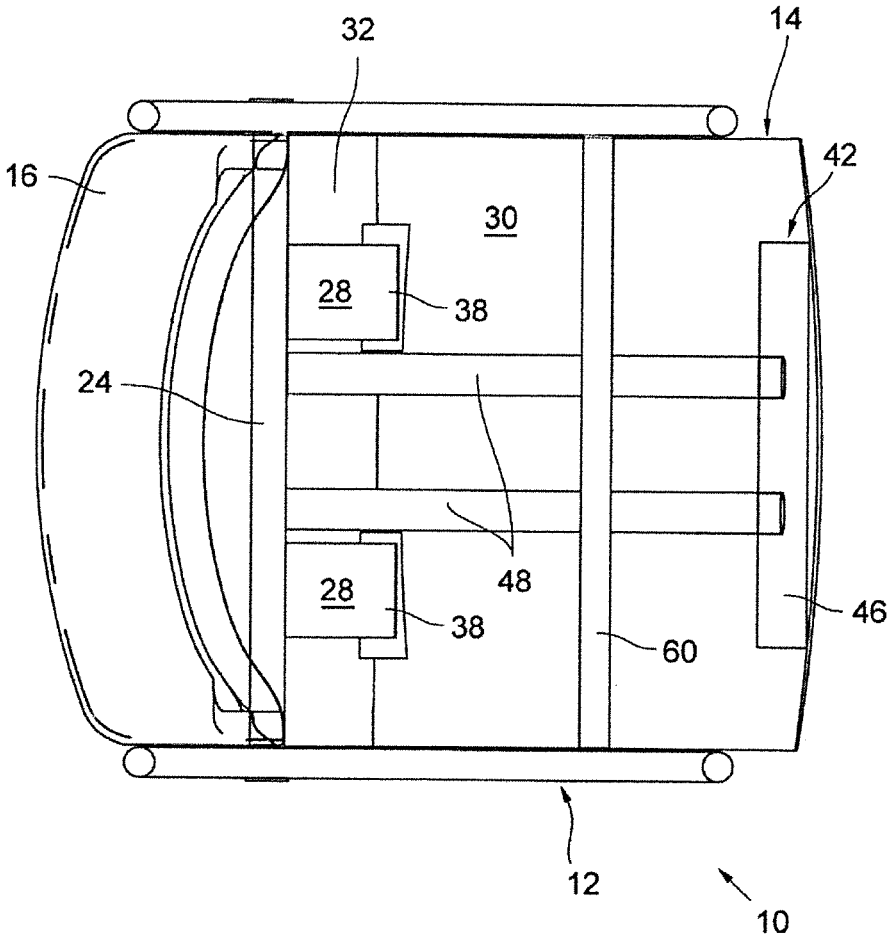
FIG. 15 is a view of the second embodiment of the chair according to the invention seen vertically from below.

In FIGS. 14 and 15 it can be seen how the pair of centre struts 48 which extend between the rear transverse axis 26 and the front pivot axis 44 runs between levers 28 on the left and right sides of chair 10. A joint 38 for connecting with the front part 30 of seat section 14 is associated with each of the two levers 28.

The above-described mechanism with the features of seat section 14 and seat back 16 and their coupling means according to the invention can be produced relatively inexpensively and is therefore suitable for use in chairs habitually deployed in large numbers, e.g. as seating in event rooms.

The invention claimed is:

1. A chair comprising:

a seat section which is at least partially deformable, an underframe which supports the seat section, a rear transverse axis oriented crosswise to the chair, a seat back mounted on the underframe such that the seat back is adapted to be pivoted around the rear transverse axis, the rear transverse axis connected to the underframe and the seat back, and at least one stiff supporting element extending from a bottom end of the seat back forwards in the extension direction of the seat section and being rigidly connected with the seat back for supporting or reinforcing a rear part of the seat section, the at least one stiff supporting element being one of in contact with or connected with a rear portion of the seat section such that when a pivoting movement of the seat back around the rear transverse axis occurs, a portion of the seat section positioned in front of the end of the at least one supporting element is caused to be raised or lowered by movement of the at least one stiff supporting element, depending on the direction of pivoting.

2. The chair of claim 1, wherein the at least one supporting element is formed as one piece with the seat section.

3. The chair of claim 1, wherein each supporting element reinforces each of two rear corner portions of the seat section, and a central rear portion of the seat section positioned between these two corner portions is separated from the corner portions by slots which extend into the seat section from the seat back.

4. The chair according to claim 1, wherein a front end of the seat section is rigidly connected with the underframe.

5. The chair according to claim 1, wherein a front end of the seat section rests freely on a front end of the underframe.

6. The chair according to claim 1, wherein the seat section is elastically deformable.

7. The chair according to claim 1, wherein each supporting element is contrived as a lever extending underneath the seat section from the rear thereof and is connected with the seat section via a joint having a joint axis positioned parallel to the rear transverse axis of the seat back.

8. The chair according to claim 7, wherein a front part of the seat section which extends forward from the joint is connected with the underframe by a pivot bearing disposed in front of the joint, wherein the front part of the seat section is mounted on the underframe such that it is adapted to be pivoted upwards and downwards.

9. The chair according to claim 7, further comprising a restoring element for restoring the lever and the seat section from a deflected position to a resting position.

10. The chair according to claim 8, wherein the pivot bearing comprises a bearing sleeve and a pivot axis disposed rigidly on the underframe and which projects inside the bearing sleeve with play, the bearing sleeve being one of:

rigidly mounted on the underside of the front end of the front part of the seat section or moulded together with the underside of the front end of the front part of the seat section so that the bearing sleeve is adapted to be moved forward and backward on the pivot axis.

11. The chair according to claim 10, further comprising a restoring element for restoring the lever and the seat section from a deflected position to a resting position, and the restoring element comprises springs positioned opposite each other inside the bearing sleeve between a sleeve wall of the bearing sleeve and the pivot axis to hold the pivot axis in a resting position in an unsolicited state, represented by an intermediate position between a maximum forward position and a maximum backward position inside the bearing sleeve.

12. The chair according to claim 1, wherein a rear part of the seat section is connected to a front part of the seat section by a film hinge.

13. The chair according to claim 1, wherein the chair is constructed in a manner to be stacked on an identical chair.

* * * * *